US006659592B2

(12) United States Patent
Vander Plas et al.

(10) Patent No.: US 6,659,592 B2
(45) Date of Patent: Dec. 9, 2003

(54) MULTIPLE REDUNDANT THROUGH HOLE ELECTRICAL INTERCONNECTS AND METHOD FOR FORMING THE SAME

(75) Inventors: Hubert Allen Vander Plas, Palo Alto, CA (US); Barry Craig Snyder, Bend, OR (US); Ron Allen Hellekson, Eugene, OR (US); Alfred I-Tsung Pan, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 138 days.

(21) Appl. No.: 09/932,123

(22) Filed: Aug. 16, 2001

(65) Prior Publication Data

US 2003/0035027 A1 Feb. 20, 2003

(51) Int. Cl.[7] ..... B41J 2/01
(52) U.S. Cl. ..... 347/50
(58) Field of Search ..... 347/50, 86, 87, 347/63; 216/18, 19

(56) References Cited

U.S. PATENT DOCUMENTS 4,964,212 A 10/1990 Deroux-Dauphin et al. .. 29/852
5,037,782 A 8/1991 Nakamura et al. ..... 437/902
5,166,097 A 11/1992 Tanielian ..... 437/203
5,425,816 A 6/1995 Cavicchi et al. ..... 136/256
5,474,651 A * 12/1995 Huebner ..... 156/644.1
5,599,744 A 2/1997 Koh et al. ..... 437/195
6,060,383 A * 5/2000 Nogami et al. ..... 438/622
6,096,635 A 8/2000 Mou et al. ..... 438/637
6,110,825 A 8/2000 Mastromatteo et al. ..... 438/667
6,188,414 B1 * 2/2001 Wong et al. ..... 347/42
6,221,769 B1 4/2001 Dhong et al. ..... 438/667
6,239,820 B1 * 5/2001 Figueredo et al. ..... 347/50

* cited by examiner

*Primary Examiner*—Michael Nghiem

(57) ABSTRACT

An apparatus incorporating multiple electrical interconnects extending through a substrate (e.g., a silicon wafer), and a method of forming the same. The electrical interconnects convey electrical signals through the substrate to structures mounted on the front side of the substrate. A conductive layer can be used to selectively distribute the electrical signals to the structures. Accordingly, it is not necessary to route electrical signals to the front side of the substrate in order to convey the signals to the structures. A structure can be coupled to multiple electrical interconnects in order to convey electrical signals along redundant paths through the substrate to the structure, improving reliability should one of the electrical interconnects fail.

23 Claims, 9 Drawing Sheets

MULTIPLE REDUNDANT THROUGH HOLE ELECTRICAL INTERCONNECTS AND METHOD FOR FORMING THE SAME

TECHNICAL FIELD

The present invention relates to the design and fabrication of integrated circuits. More specifically, the present invention pertains to the design and fabrication of integrated circuits used in printheads for ink-jet printers.

BACKGROUND ART

Ink-jet printer cartridges include printhead structures in which small droplets of ink are formed and ejected toward a printing medium. The printhead structures have orifice plates incorporating very small nozzles through which the ink droplets are ejected. Ejection of an ink droplet through a nozzle is accomplished by heating a volume of ink in an adjacent ink chamber. The expansion of the ink forces a droplet of ink through the nozzle, a process referred to as "firing." The ink in the chamber is typically heated with a resistive heating material aligned with the nozzle and chamber.

Prior Art FIG. 1 illustrates an exemplary ink-jet printer cartridge 12 used in a printer such as a thermal ink-jet printer. A printhead 20 with an orifice plate 33 is fit into the bottom of the cartridge 12. The printhead 20 includes nozzles 25 through which ink is ejected in a controlled pattern during printing. Depending on the resolution of the printer, an array of 600 or more nozzles may be used. A flexible circuit 24 is mounted to the exterior of the cartridge 12. Circuit contact pads 23 are for electrically coupling the cartridge 12 to a matching circuit in the printer.

Prior Art FIG. 2 is a cross-sectional view of a portion of printhead 20 comprising a substrate 10, a conductive layer 22, and a printhead structure 40. For simplicity of illustration, a single printhead structure 40 is shown; however, in actuality, many (e.g., 600) printhead structures are used.

Substrate 10 is typically a silicon wafer although other materials may be used. Substrate 10 may be separated from the conductive layer 22 by an insulation layer 14 (e.g., a dielectric). Insulation layer 14 may be omitted if substrate 10 possesses dielectric and heat transfer characteristics suitable for directly receiving conductive layer 22.

In general usage and as used herein, conductive layer 22 is a generic term that includes both metallic (e.g., aluminum) lines and complementary metal oxide semiconductor (CMOS) logic circuits. Conductive layer 22, under control of a microprocessor and associated drivers in the printer, selectively distributes electrical signals to each of the printhead structures 40 so that they fire in a controlled pattern to produce on the printable medium the desired characters and images.

Printhead structure 40 includes resistive heating material (resistor) 30 adjacent to a firing chamber 44, an ink barrier 38, and a nozzle 25 formed in orifice plate 33 and in fluid communication with firing chamber 44. Conductive layer 22 includes a bonding pad 27 to which a lead from flexible circuit 24 (FIG. 1) is attached. Flexible circuit 24 carries signals generated by the microprocessor and associated drivers in the printer to conductive layer 22 via bonding pad 27. These signals prescribe which of the printhead structures 40 are to fire, depending on the character or image to be generated. Conductive layer 22 selectively provides electrical signals to resistor 30, which in turn produces an amount of heat sufficient for vaporizing some of the ink in firing chamber 44, thereby forcing an ink droplet through nozzle 25.

A problem with printheads of the prior art is that care must be taken to ensure that the electrical connections from the printer and/or print cartridge to the printhead structure are not exposed to the ink ejected from the printhead structure. The ink droplets exist as a fine mist (aerosol) and, although directed to the printable medium, may float back onto printhead structure 40, conductive layer 22, and the connection between bonding pad 27 and flexible circuit 24 (FIG. 2). Therefore, the electrical connections and other components are generally coated with some type of protective material to shield them from the ink.

However, the ink is very corrosive and eventually may penetrate the protective coating and damage electrical connections in the bond 27 between conductive layer 22 and flexible circuit 24, in conductive layer 22, or elsewhere. Electrical connections to some of the printhead structures or emanating from any other source may consequently fail or degrade to the point where current sufficient for heating resistor 30 cannot be provided. As a result, some of the printhead structures may not fire when they are supposed to, thus reducing print quality. To address this problem, what is needed is a method and/or apparatus that can protect electrical connections in the printhead from the corrosive effects of ink.

Another problem with the prior art is that the routing of the electrical signals to the printhead structures 40 can consume valuable space in printhead 20. As the number of printhead structures 40 increases (e.g., to achieve higher print qualities), the routing of the signals to the resistors 30 consumes more of the surface area on substrate 10. In addition, the routing of signals becomes more complex with an increasing number of printhead structures 40.

These latter problems are also experienced in applications other than ink-jet printers that utilize packaged integrated circuits (e.g., a semiconductor or integrated circuit die coupled with one or more structures or logic devices and mounted on a substrate). Generally, contacts for electrical signals from external sources to a packaged integrated circuit are situated toward the edge of the package or substrate. External electrical signals are therefore routed to the edge of the package or substrate, then routed to the various devices or structures that are included in the package. As logic devices become more complex, the routing of electrical signals to the integrated circuit package and within the package becomes more difficult and consumes greater quantities of the limited space available.

Therefore, what is also needed is a method and/or apparatus that can reduce the difficulty of routing electrical signals to integrated circuits and integrated circuit packages and that can reduce the area consumed by such routing, not only in ink-jet printers but in other applications as well. The present invention provides a novel solution to the above needs.

DISCLOSURE OF THE INVENTION

The present invention provides both an apparatus that can protect electrical connections from the corrosive effects of ink in an ink-jet printer and a method of forming such an apparatus. In addition, the present invention provides an apparatus (and a method for forming an apparatus) that can reduce the difficulty of routing electrical signals and that can reduce the area consumed by such routing, not only in ink-jet printers but in other applications as well.

The present invention pertains to an apparatus incorporating multiple electrical interconnects extending through a substrate (e.g., a silicon wafer). The electrical interconnects convey electrical signals through the substrate to structures (devices) mounted on the front side of the substrate. Accordingly, it is not necessary to route electrical signals to or along the front surface of the substrate in order to convey the signals to the structures, thereby reducing the difficulty of routing electrical signals as well as reducing the area consumed by such routing.

In one embodiment, each structure is electrically coupled to multiple parallel electrical interconnects extending through the substrate such that the electrical signals are carried to the structure by redundant electrical paths. The use of redundant paths can improve reliability because if an electrical interconnect should fail, electrical signals are still provided to the structure through the remaining interconnects.

In one embodiment, the present invention is implemented in an ink-jet print cartridge. The electrical interconnects convey electrical signals through the substrate to printhead structures mounted on the substrate. A conductive layer may be mounted between the substrate and the printhead structures to selectively distribute the electrical signals to the printhead structures. By routing the electrical signals through the substrate, the electrical connections are not exposed to the corrosive effects of the ink ejected from the printhead structures.

The present invention also pertains to a method of forming electrical interconnects through a substrate to structures (devices) mounted on the front side of the substrate. In one embodiment, the method is used to form electrical interconnects for conveying electrical signals through the substrate to ink-jet printhead structures.

In accordance with the present invention, a wet or dry etching process, or another viable process, is used to form a plurality of parallel holes through the substrate. In one embodiment, the holes are formed without reducing the thickness of the substrate.

The holes formed in the substrate in accordance with the present invention have a relatively high aspect ratio (the ratio of their depth to their diameter). In the present embodiment, electric interconnects are formed by coating the sidewalls of the holes in the substrate with a dielectric material and also with a conducting material such that the holes are not completely filled in. Some of the holes may be then filled in with a conducting material. In one embodiment, atomic layer deposition is used to deposit the dielectric material and the conducting material in the holes that are not completely filled in. Electroplating can be used to fill in some of the holes with conducting material. In one embodiment, the electrical interconnect to a structure is formed by electrically coupling the structure to multiple electrical interconnects such that electrical signals to the structure are carried by redundant electrical paths.

In summary, the present invention provides an apparatus incorporating multiple electrical interconnects extending through a substrate, in which a structure is coupled to one or more of the interconnects, and a method of forming the same. As such, it is not necessary to route electrical signals to and along the front surface of the substrate in order to convey the signals to structures mounted on the substrate, simplifying the routing of the signals and reducing the space needed for the routing on the front (top) surface. In an ink-jet printer application, the electrical connections are not exposed to the corrosive effects of ink expelled from printhead structures. These and other objects and advantages of the present invention will become obvious to those of ordinary skill in the art after having read the following detailed description of the preferred embodiments that are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

Prior Art

Prior Art

BEST MODE FOR CARRYING OUT THE INVENTION

Figure 1:
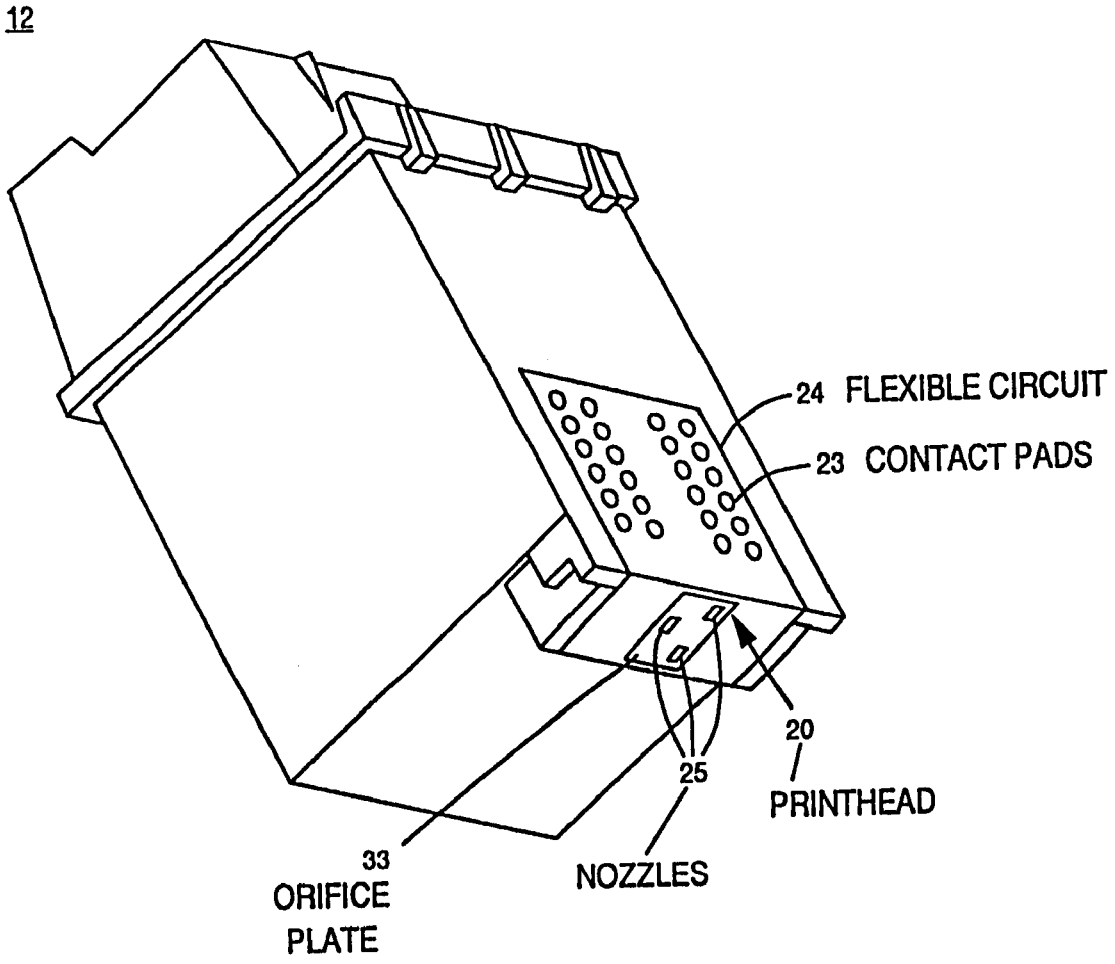
Figure 1 (Prior Art)
FIG. 1 is a perspective drawing of an exemplary ink-jet printer cartridge used in an ink-jet printer.
Figure 2:
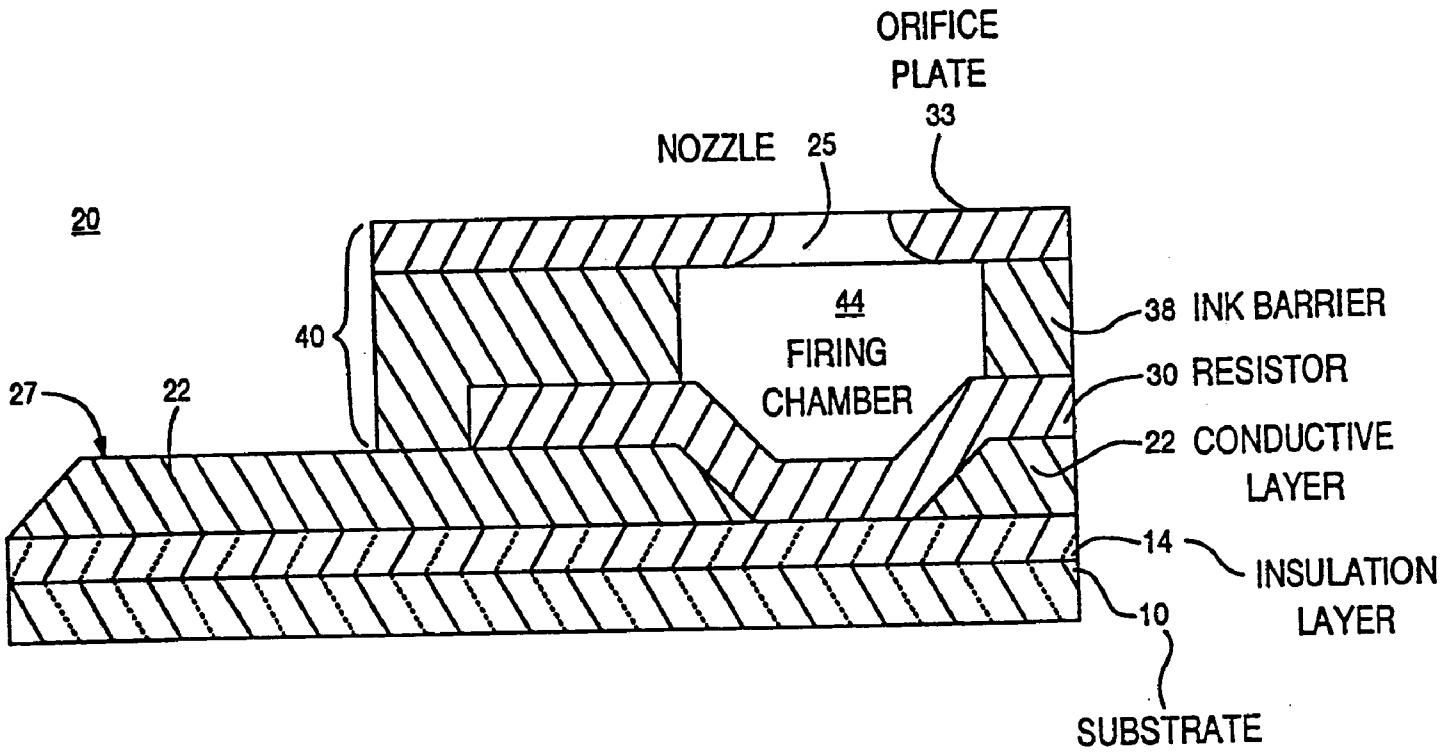
Figure 2 (Prior Art)
FIG. 2 is a cross-sectional view of a portion of a printhead used in an ink-jet printer cartridge.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Some portions of the detailed descriptions which follow are presented in terms of procedures, logic blocks, processing, and other symbolic representations of operations for fabricating integrated circuits on a wafer. These descriptions and representations are the means used by those skilled in the art of wafer fabrication to most effectively convey the substance of their work to others skilled in the art. In the present application, a procedure, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system to fabricate an integrated circuit.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "receiving," "depositing," "forming," "coupling," or the like, refer to actions and processes (e.g., process 500 of FIG. 5) of integrated circuit fabrication.

The present invention is described in the context of a printhead used in a thermal ink-jet printer. In simplest terms, the printhead includes printhead structures mounted on a substrate. In this embodiment, electrical signals are provided to each printhead structure by one or more electrical interconnects extending through the substrate. Although the present invention is described in the context of a printhead, it will be apparent that the present invention can be extended to other applications. In general, the present invention can be used to provide electrical signals through a substrate to a structure or structures mounted on the substrate.

Figure 3:
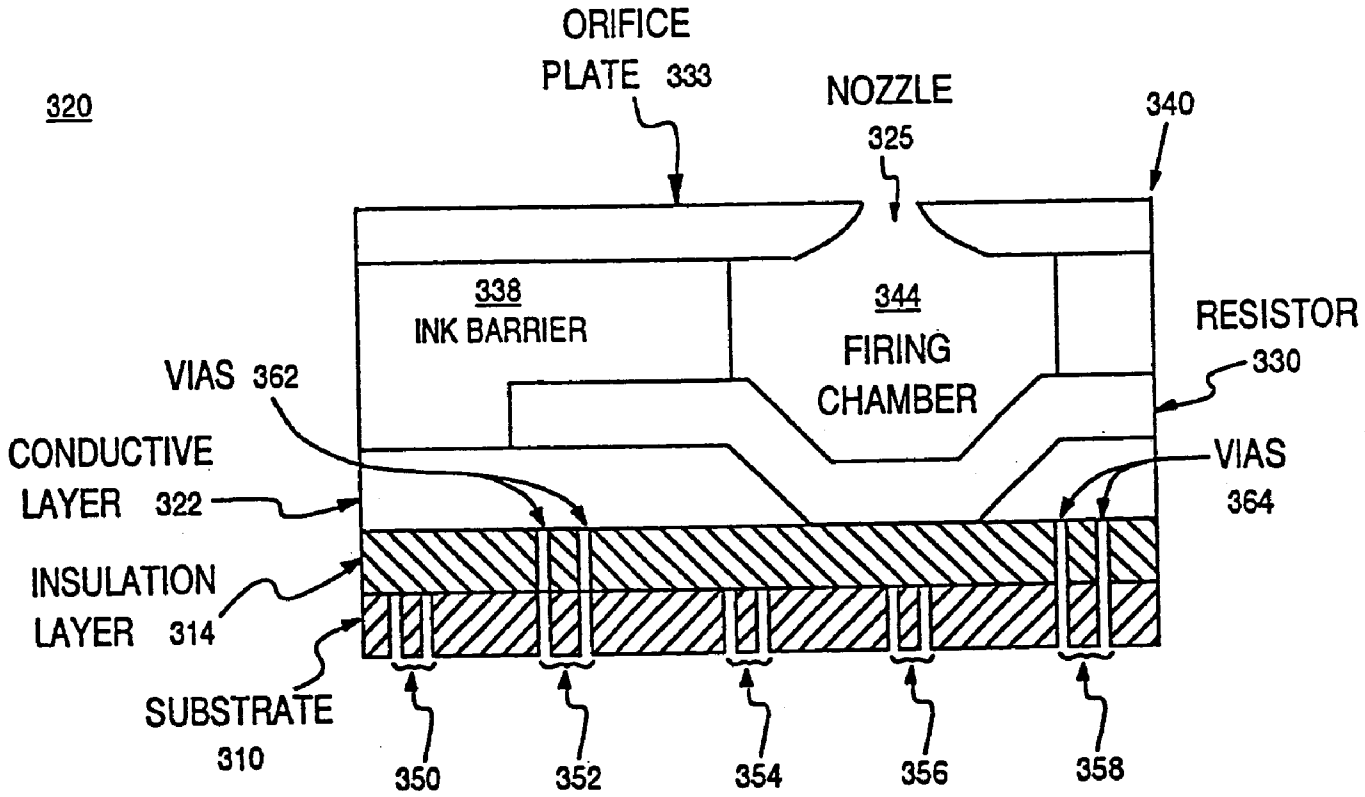
FIG. 3 is a cross-sectional view of a printhead showing electrical interconnects extending through the substrate in accordance with one embodiment of the present invention.

FIG. 3 is a cross-sectional view of a printhead 320 showing electrical interconnects extending through the substrate 310 in accordance with one embodiment of the present invention. In the present embodiment, printhead 320 includes a substrate 310, a conductive layer 322, and a printhead structure 340. Although only a single printhead structure 340 is shown, it is understood that multiple printhead structures 340 may actually be used in accordance with the present invention.

Substrate 310 is typically a silicon wafer although other materials with characteristics similar to silicon may be used. In accordance with the present invention, a number of holes (350, 352, 354, 356 and 358) are formed in and extend through substrate 310. Each hole may be used to form an electrical interconnect. A structure (e.g., printhead structure 340) may be electrically coupled to a single electrical interconnect. A structure may also be electrically coupled to multiple electrical interconnects that provide redundant electrical paths to the structure.

In the description below, the holes are illustrated as being grouped in pairs (350, 352, 354, 356 and 358). However, it is understood that the present invention is not limited to working with pairs of holes. It is also understood that the spacing of the holes may be different from that illustrated. Although shown as irregularly spaced, the holes may actually be uniformly spaced. Furthermore, although in the description below adjacent holes (adjacent electrical interconnects) are coupled to the printhead structure 340 to provide redundant electrical paths, it is understood that this may also be accomplished using non-adjacent holes (non-adjacent electrical interconnects).

As described further in conjunction with FIGS. 4A–4E and 5 (below), electrical interconnects are formed from the holes by coating the sidewalls of the holes with a dielectric material and a conducting material such that the holes are not completely filled in. Some of the holes are also completely filled in with a conducting material. Some of the electrical interconnects (e.g., those formed from holes 352 and 358, and hereinafter referred to as electrical interconnects 352 and 358, respectively) are selected to conduct electrical signals from the bottom surface of substrate 310 and through the substrate, while the remaining electrical interconnects (e.g., those formed from holes 350, 354 and 356) are sealed off and not used.

Continuing with reference to FIG. 3, in one embodiment, insulation layer 314 (e.g., a dielectric) is applied over the substrate 310. Insulation layer 314 serves as a thermal and electrical insulator between substrate 310 and conductive layer 322. Insulation layer 314 can also serve to seal the unused electrical interconnects (e.g., those formed from holes 350, 354 and 356) from conductive layer 322. Insulation layer 314 may be omitted if substrate 310 possesses dielectric and heat transfer characteristics suitable for directly receiving conductive layer 322, in which case electrical interconnects formed from holes 350, 354 and 356 are sealed from conductive layer 322 using a different mechanism known in the art. Alternatively, conductive layer 322 can be formed such that it does not have electrical contacts in positions to receive signals from electrical interconnects formed from holes 350, 354 and 356.

In one embodiment of the present invention, multiple electrical interconnects are used to convey the electrical signals for each printhead structure 340. For example, printhead structure 340 may be electrically coupled to the two-dimensional array of electrical interconnects 358 extending through the substrate 310. As illustrated in FIG. 4B (below), this array may be a subset of a larger two-dimensional array. The electrical interconnects 358 are made by electrically connecting the individual interconnects in the array at both the top and bottom of the substrate 310. Thus, the electrical interconnects 358 can be used to provide a single electrical signal for printhead structure 340. Likewise, the electrical interconnects 352, also a two-dimensional array, can be used to provide electrical signals for another printhead structure (not shown). Similarly, electrical interconnects 352 and 358 can both be used to provide electrical signals for printhead structure 340, while other electrical interconnects (not shown) can be used to provide electrical signals for other printhead structures. In each of these cases, should one of the electrical interconnects in the array of electrical interconnects fail, electrical signals are still provided to the respective printhead structure by the electrical interconnects remaining in the array of electrical interconnects.

In one embodiment, vias (e.g., 362 and 364) are formed in insulation layer 314 for conveying electrical signals from some of the electrical interconnects (e.g., 352 and 358) through insulation layer 314 to conductive layer 322.

In general usage and as used herein, conductive layer 322 is a generic term that includes both metallic (e.g., aluminum) lines or layers and complementary metal oxide semiconductor (CMOS) logic circuits. Conductive layer 322, under control of the microprocessor and associated drivers, selectively distributes electrical signals delivered through substrate 310 (by electrical interconnects 352 and/or 358, for example) to printhead structure 340.

It is appreciated that instead of a single conductive layer and insulation layer, multiple conductive (e.g., semiconductor) layers, separated from each other by an insulation layer and electrically coupled using vias, may be used. It is also appreciated that mechanisms other than a semiconductor may be used to distribute electrical signals to the printhead structures 340. For example, a demultiplexer can be formed on substrate 310 for distributing incoming signals to the various printhead structures 340. A direct connection between the electrical interconnects 352 and 358 and a respective printhead structure 340 can also be envisioned.

In response to a signal or signals received from conductive layer 322, printhead structures 340 fire in a controlled pattern to produce on a printable medium the desired characters and images. In the present embodiment, printhead structure 340 includes resistive heating material (resistor) 330 adjacent to a firing chamber 344, an ink barrier 338, and a nozzle 325 formed in orifice plate 333 and in fluid communication with firing chamber 344. In response to the signals from conductive layer 322, resistor 330 produces an amount of heat sufficient for vaporizing some of the ink in firing chamber 344, thereby forcing an ink droplet through nozzle 325 and onto a printable medium.

Thus, in accordance with the present invention, signals that are generated external to printhead 320 are routed to the back side (bottom surface) of the substrate 310 instead of to the front surface. The signals are conveyed by electrical interconnects (e.g., 352 and 358) to conductive layer 322 and/or to structures mounted on substrate 310 (e.g., printhead structure 340). Accordingly, electrical connections to printhead 320 are not exposed to ink ejected from printhead structure 340, improving the reliability of the printhead. Reliability is further improved by the use of redundant electrical interconnects for each printhead structure 340.

In addition, valuable surface area on the upper (front) surface of substrate 310 is not consumed by the routing of the electrical connections to printhead structure 340. Furthermore, the present invention enhances the scalability of printhead 320 to ever increasing numbers of printhead structures 340. That is, the number of printhead structures 340 can be increased without increasing the complexity of routing electrical signals to each structure.

As mentioned above, although described in the context of a printhead 320, other applications using the present invention can be contemplated. In general, the present invention can be used to convey electrical signals from one surface of a substrate to structures mounted on the other surface.

Figure 4A:
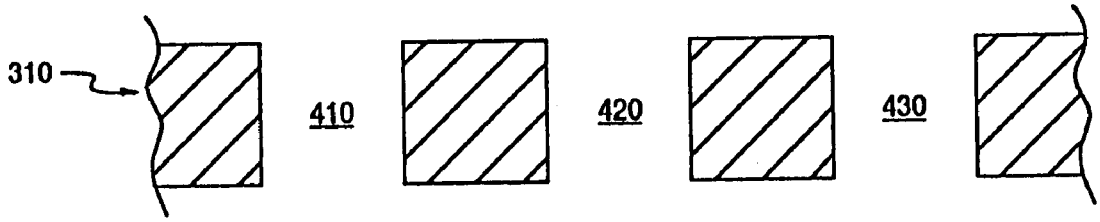
FIG. 4A is a cross-sectional view of a substrate with holes extending therethrough in accordance with one embodiment of the present invention.
Figure 4B:
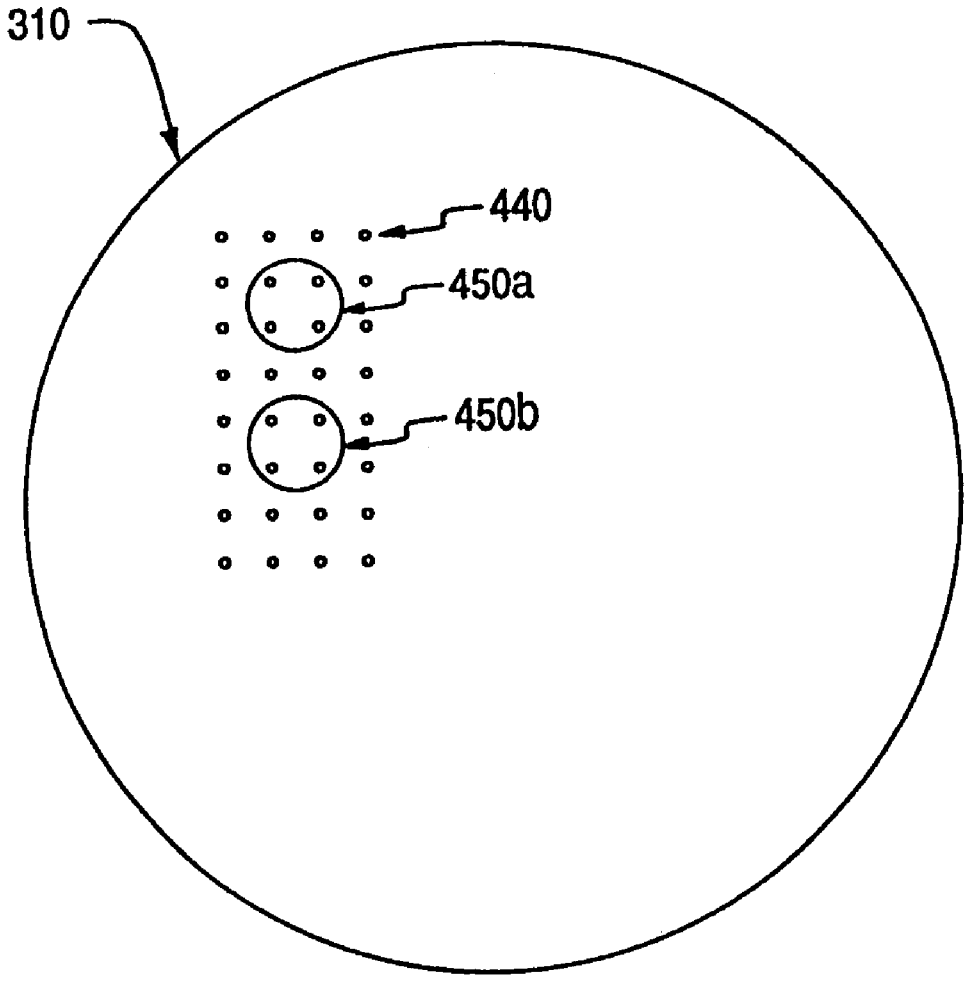
FIG. 4B is a top view of a substrate with holes extending therethrough in accordance with one embodiment of the present invention.

FIG. 4A is a cross-sectional view of a substrate 310 with holes 410, 420 and 430 extending therethrough in accordance with one embodiment of the present invention. The holes 410, 420 and 430 are representative of the holes 350, 352, 354, 356 and 358 shown in FIG. 3 that are used for forming electrical interconnects through substrate 310. Although three holes are illustrated, it is understood that many holes may actually be present in substrate 310.

In the present embodiment of the present invention, the holes 410, 420 and 430 of FIG. 4A are formed in substrate 310 at the beginning of the fabrication process. In one embodiment, the holes 410, 420 and 430 are formed anisotropically. Various techniques such as wet, dry, laser or plasma etching can be used to form the holes 410, 420 and 430. In one embodiment, the holes 410, 420 and 430 are formed without reducing the thickness of substrate 310 in order to form the holes. In that embodiment, the holes 410, 420 and 430 have a depth of approximately 675 microns.

In one embodiment, the holes 410, 420 and 430 each have a diameter that is less than the diameter of the electrical contacts to which they will be coupled. Thus, multiple holes can be used to form redundant electrical interconnects for each structure mounted on substrate 310 (e.g., printhead structure 340 of FIG. 3). In one such embodiment, the holes 410, 420 and 430 have a diameter of approximately eight (8) microns and a center-to-center spacing (pitch) of approximately ten (10) microns. However, it is appreciated that holes with diameters and pitches other than 8 and 10 microns, respectively, may be used, including holes having diameters and pitches significantly different from these values. In addition, holes with diameters different from each other and that are non-uniformly spaced (that have varying pitches) may also be used.

FIG. 4B is a top view of a substrate 310 with holes (exemplified by 440) extending therethrough in accordance with one embodiment of the present invention. The larger circles 450*a* and 450*b* represent the footprints of the electrical contacts on, for example, conductive layer 322 or printhead structure 340 (FIG. 3). Thus, in this embodiment, the diameter of the holes 440 in substrate 310 are less than the diameter of the desired electrical contacts. Although FIG. 4B illustrates holes formed isotropically, it is appreciated that the holes may be formed anisotropically.

Figure 4C:
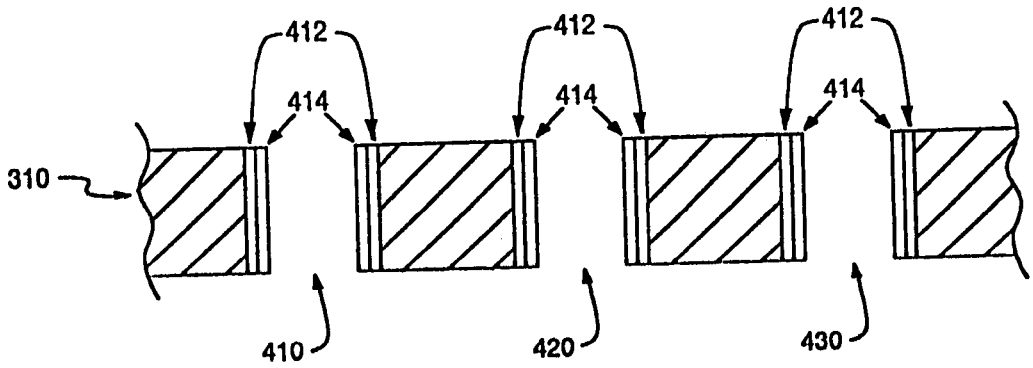
FIG. 4C is a cross-sectional view of a substrate with through holes that are coated with a dielectric material and a conducting material in accordance with one embodiment of the present invention.

FIG. 4C is a cross-sectional view of a substrate 310 with through holes 410, 420 and 430 that are coated with a dielectric material 412 and a conducting material 414 in accordance with one embodiment of the present invention. After the holes are formed, a dielectric material 412 such as silicon dioxide, silicon nitride or aluminum oxide is applied to the sidewalls of each hole, to prevent electrical contact between subsequent metal depositions and substrate 310. After deposition of dielectric material 412, a conducting material 414 such as copper, tantalum or titanium nitride is applied to the sidewalls of each hole. In the present embodiment, the thickness of the dielectric material 412 and of the conducting material 414 are in the range of 200 to 10,000 Angstrom. Thus, at this stage in the present embodiment, the holes 410, 420 and 430 are not completely filled in but are lined with insulating and conductive films.

Atomic layer deposition (ALD) provides one process for depositing dielectric material 412 and conducting material 414 into holes 410, 420 and 430, particularly considering the relatively high aspect ratio of the holes (the ratio of their depth to their diameter). ALD provides a relatively slow deposition rate; however, ALD is compatible with coating uniformly a large surface simultaneously. Thus, the use of a series of small diameter holes as in the present invention will result in a greater area being coated per unit of time than with the use of larger holes. Although ALD provides some advantages, it is appreciated that other techniques can be used to apply dielectric material 412 and conducting material 414.

Figure 4D:
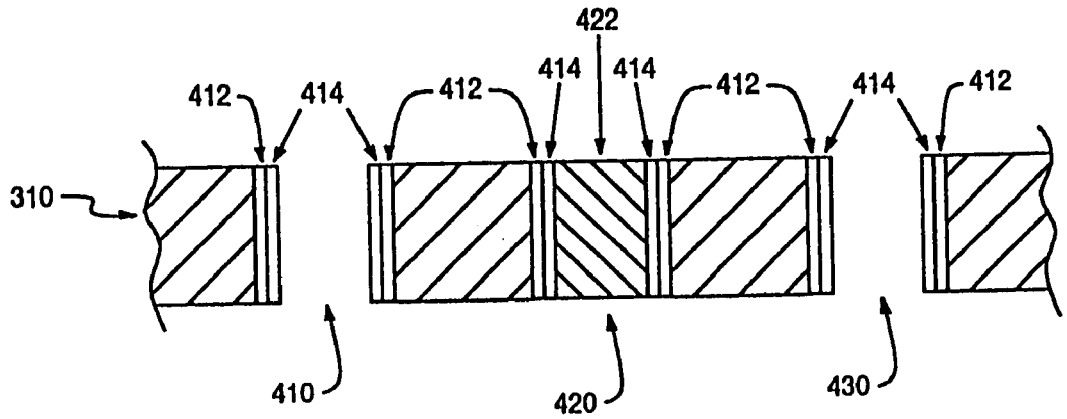
FIG. 4D is a cross-sectional view of a substrate with a hole that is filled with a conducting material in accordance with one embodiment of the present invention.

FIG. 4D is a cross-sectional view of a substrate 310 with a through hole 420 that is filled with additional conducting material 422 (e.g., copper) in accordance with one embodiment of the present invention. In accordance with the present invention, some of the holes formed in substrate 310 are solidly filled in order to plug the hole. In the present embodiment, those holes that will not be used as electrical interconnects (e.g., 350, 354 and 356 of FIG. 3) are plugged. By plugging the holes, the vacuum handling that is typical of many wafer fabrication processes and equipment can be used without modification. Also, holes that are left unplugged may later trap liquids or other substances, and thus plugging the unused holes eliminates this potential issue. The use of smaller holes in substrate 310, in addition to the advantages stated above, also allows these holes to be more readily plugged than larger holes. The use of smaller holes also means that holes that are not plugged will have a lesser effect on the vacuum handling than larger holes.

In one embodiment, hole 420 of FIG. 4D is plugged using an electroplating technique. In this embodiment, after ALD of conducting material 414, a conductive film is sputtered on the back surface of substrate 310. This film makes contact with conducting material 414. Substrate 310 is placed in a plating solution such that only its front surface is in the plating solution. By applying an electrical potential to the back surface of substrate 310, electroplating will occur preferentially from the bottom of hole 420. The material deposited by electroplating will continue to grow up the circumference of hole 420 until the hole is plugged.

Figure 4E:
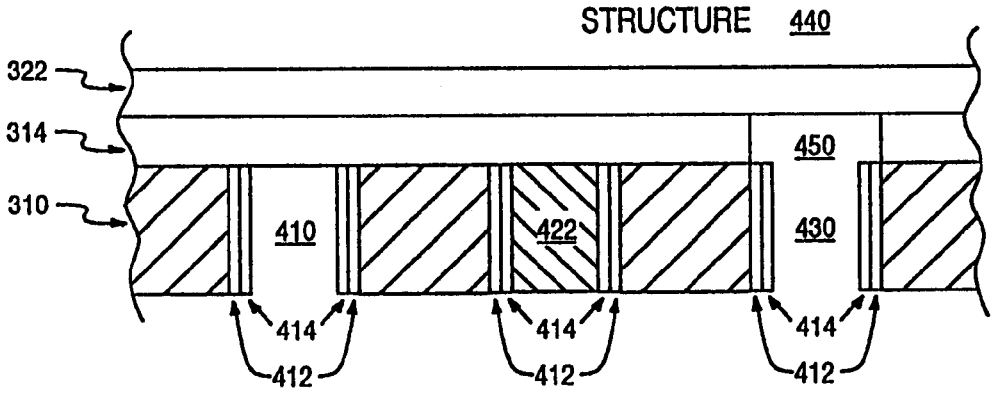
FIG. 4E is a cross-sectional view of a substrate with electrical interconnects extending therethrough upon which a dielectric layer having a selectively placed via has been deposited in accordance with one embodiment of the present invention.

FIG. 4E is a cross-sectional view of a substrate 310 with electrical interconnects 410 and 430 extending therethrough in accordance with one embodiment of the present invention. In this embodiment, an insulating (dielectric) layer 314 having a selectively placed via 450 has been deposited on the substrate 310, and a conductive layer 322 has been deposited over insulating layer 314. The via 450 provides an electrical contact between electrical interconnect 430 and conductive layer 322, allowing electrical signals to be conveyed through substrate 310 to a structure 440 (e.g., printhead structure 340 of FIG. 3) built on conductive layer 322. Electrical interconnect 410 is insulated from conductive layer 322 and thus is not used for providing electrical signals through substrate 310 to structure 440. Alternatively, electrical interconnect 410 can be plugged as described above. Also, as described above, multiple electrical interconnects formed through substrate 310 can be used to provide electrical signals to structure 440; for example, a via can also be formed over electrical interconnect 410, and electrical interconnects 410 and 430 can both be electrically coupled to structure 440.

A method for forming insulating layer 314, conductive layer 322, via 450 and structure 440 is described in U.S. Pat. No. 6,239,820 entitled "Thin-Film Printhead Device for an Ink-Jet Printer," assigned to the assignee of the present invention and herein incorporated by reference.

Figure 5:
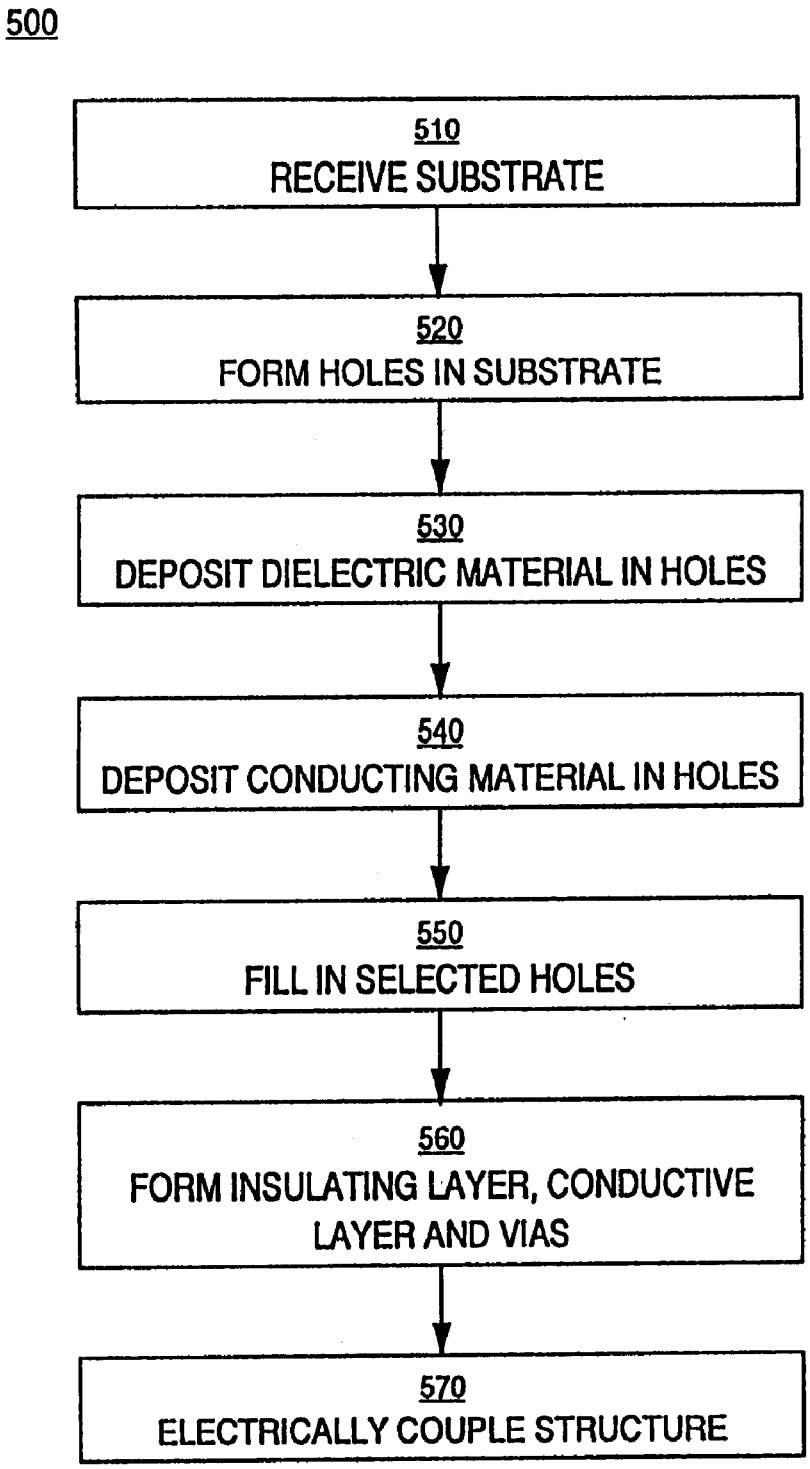
FIG. 5 is a flowchart of the steps in a process for forming electrical interconnects through a substrate to structures mounted on the front surface of the substrate in accordance with one embodiment of the present invention.

FIG. 5 is a flowchart of the steps in a process 500 for forming electrical interconnects through a substrate to structures mounted on the front surface of the substrate in accordance with one embodiment of the present invention. In step 510, a substrate 310 (FIG. 4A) is received into a wafer fabrication process known in the art. In step 520, holes 410, 420 and 430 (FIG. 4A) are formed in the substrate 310. In steps 530 and 540, respectively, a layer of dielectric material 412 and a layer of conducting material 414 (FIG. 4C) are deposited into the holes 410, 420 and 430. In step 550, some of the holes (e.g., hole 420) are plugged with additional conducting material 422. In step 560, insulating layer 314, via 450, and conductive layer 322 (FIG. 4E) are built on substrate 310. In step 570, a structure 440 (FIG. 4E) is built or mounted on substrate 310 and electrically coupled to the electrical interconnect 430. Electrical signals can thereby be distributed to structure 440 from the back surface of substrate 310 and through substrate 310 rather than along the front surface of substrate 310 as is the current convention.

In summary, the present invention provides an apparatus incorporating multiple electrical interconnects extending through a substrate, in which a structure is coupled to one or more of the interconnects, and a method of forming the same. As such, it is not necessary to route electrical signals to the front side of the substrate in order to convey the signals to structures mounted on the substrate, simplifying the routing of the signals and reducing the space needed for the routing on the top surface. In an ink-jet printer application, the electrical connections are not exposed to the corrosive effects of ink expelled from printhead structures.

The preferred embodiment of the present invention, multiple redundant through hole electrical interconnects and method for forming the same, is thus described. While the present invention has been described in particular embodiments, it should be appreciated that the present invention should not be construed as limited by such embodiments, but rather construed according to the following claims.

What is claimed is:

1. An apparatus comprising:

a substrate having a plurality of electrical interconnects extending therethrough, said electrical interconnects for conveying electrical signals through said substrate such that said electrical signals are carried by redundant paths, wherein said electrical interconnects comprise a first number of holes in said substrate having sidewalls lined with a conducting material such that said first number of holes are not solidly filled;

a conductive layer mounted on said substrate and operable to receive and distribute said electrical signals delivered through said substrate via said electrical interconnects; and a structure electrically coupled to said conductive layer and operable to receive said electrical signals through an electrical contact that has an area larger than an area of each of said first number of holes, said electrical contact electrically coupled to more than one of said first number of holes, wherein redundant electrical paths are provided to said electrical contact.

2. The apparatus of claim 1 comprising a via positioned adjacent to at least one of said electrical interconnects, said via for passing electrical signals to said conductive layer.

3. The apparatus of claim 1 wherein said substrate is a silicon wafer.

4. The apparatus of claim 1 wherein said conductive layer is a circuit comprised of a metallic layer and a complementary metal oxide semiconductor logic circuit.

5. The apparatus of claim 1 wherein said structure comprises a printhead structure operable to eject ink in response to said electrical signals.

6. The apparatus of claim 1 wherein said electrical interconnects comprise a second number of holes in said substrate that are solidly filled with a conducting material.

7. An ink-jet print cartridge comprising:

a substrate having a plurality of electrical interconnects extending therethrough, said electrical interconnects for conveying electrical signals through said substrate, wherein said electrical interconnects comprise a first number of holes in said substrate having sidewalls lined with a conducting material such that said first number of holes are not solidly filled; and a plurality of ink-jet printhead structures electrically coupled to said electrical interconnects and operable to receive said electrical signals delivered through said substrate, wherein said electrical signals are distributed to selected printhead structures and wherein said electrical signal cause ink in a firing chamber of a selected printhead structure to be emitted from said firing chamber and onto a printing medium, wherein each printhead structure is electrically coupled to said electrical interconnects through an electrical contact that has an area larger than an area of each of said first number of holes, said electrical contact electrically coupled to more than one of said first number of holes, wherein redundant electrical paths are provided to said electrical contact.

8. The ink-jet print cartridge of claim 7 comprising a conductive layer mounted on said substrate and operable to receive and selectively distribute to said printhead structures said electrical signals conveyed through said substrate.

9. The ink-jet print cartridge of claim 8 comprising vias positioned adjacent to selected electrical interconnects for passing electrical signals from said selected electrical interconnects to said conductive layer.

10. The ink-jet print cartridge of claim 8 wherein said conductive layer is a circuit comprised of a metallic layer and a complementary metal oxide semiconductor logic circuit.

11. The ink-jet cartridge of claim 7 wherein said substrate is a silicon wafer.

12. The ink-jet print cartridge of claim 7 wherein said electrical interconnects comprise a second number of holes in said substrate that are solidly filled with a conducting material.

13. The method for forming an electrical interconnect through a substrate wherein said electrical interconnect is for conveying electrical signals to a structure mounted on said substrate, said method comprising:

a) receiving said substrate;

b) forming a plurality of holes extending through said substrate, wherein said holes are formed without reducing the thickness of said substrate and wherein said holes have a diameter less than the diameter of electrical contacts on said structure;

c) depositing a dielectric material in said holes such that said dielectric material coats the sidewalls of said holes;

d) depositing a conducting material in said holes to form a plurality of electrical interconnects through said substrate such that said conducting material lines the sidewalls of said holes and said holes are not solidly filled; and e) coupling electrically said structure to said electrical interconnects such that said electrical signals are carried by redundant electrical paths.

14. The method as recited in claim 13 comprising:

forming a conductive layer on said substrate, said conductive layer operable to receive and selectively distribute to said structure said electrical signals conveyed through said substrate.

15. The method as recited in claim 14 comprising:

forming a via adjacent to at least one of said electrical interconnects, said via for passing electrical signals from said at least one electrical interconnect to said conductive layer.

16. The method as recited in claim 14 wherein said conductive layer is a circuit comprised of a metallic layer and a complementary metal oxide semiconductor logic circuit.

17. The method as recited in claim 13 wherein said substrate is a silicon wafer.

18. The method as recited in claim 13 wherein said structure comprises a printhead structure operable to eject ink in response to said electrical signals.

19. The method as recited in claim 13 comprising:

depositing additional conducting material in said holes such that said holes are solidly filled.

20. The method as recited in claim 19 wherein said additional conducting material is deposited using an electroplating process.

21. The method as recited in claim 13 wherein said dielectric material and said conducting material are deposited using an atomic layer deposition process.

22. A method for forming an electrical interconnect through a substrate wherein said electrical interconnect is for conveying electrical signals to an ink-jet, printhead structure mounted on said substrate in an ink-jet print cartridge, said method comprising:

a) receiving said substrate;

b) forming a hole extending through said substrate, wherein said hole is formed without reducing the thickness of said substrate and wherein said hole has a diameter less than the diameter of an electrical contact on said ink-jet printhead structure;

c) depositing by atomic layer deposition a dielectric material in said hole such that said dielectric material coats the sidewalls of said hole;

d) depositing by atomic layer deposition a conducting material in said hole to form said electrical interconnect through said substrate such that said conducting material lines the sidewalls of said hole and said hole is not solidly filled; and e) coupling electrically said ink-jet printhead structure to said electrical interconnect by forming a conductive layer on said substrate, said conductive layer operable to receive and selectively distribute to said ink-jet printhead structure said electrical signals conveyed through said substrate.

23. The method as recited in claim 22 wherein said substrate is a silicon wafer.

* * * * *